US009901939B2

(12) United States Patent
Lin et al.

(10) Patent No.: US 9,901,939 B2
(45) Date of Patent: Feb. 27, 2018

(54) MULTIFUNCTIONAL SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Wencong Xu, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 120 days.

(21) Appl. No.: 14/981,241

(22) Filed: Dec. 28, 2015

(65) Prior Publication Data

US 2016/0221006 A1 Aug. 4, 2016

(30) Foreign Application Priority Data

Feb. 4, 2015 (CN) ..... 2015 1 0057834

(51) Int. Cl.
*B05B 1/18* (2006.01)
*B05B 1/12* (2006.01)
*B05B 1/16* (2006.01)

(52) U.S. Cl.
CPC ..... *B05B 1/185* (2013.01); *B05B 1/12* (2013.01); *B05B 1/169* (2013.01); *B05B 1/1636* (2013.01); *B05B 1/18* (2013.01)

(58) Field of Classification Search
CPC ..... B05B 1/185; B05B 1/12; B05B 1/1636; B05B 1/169; B05B 1/18; B05B 1/1663; B05B 1/1681
USPC ..... 239/436–449, 451–460, 581.1
See application file for complete search history.

(56) References Cited

U.S. PATENT DOCUMENTS 5,433,384 A * 7/1995 Chan ..... B05B 1/1636 239/239
8,020,786 B2 * 9/2011 Lo ..... B05B 1/1609 239/237
8,066,203 B2 * 11/2011 Zhou ..... B05B 1/1636 239/443
2012/0305116 A1 * 12/2012 Zhou ..... B05B 1/1636 137/625.46
2014/0027234 A1 * 1/2014 Zhou ..... B05B 1/1636 192/43.1

* cited by examiner

*Primary Examiner* — Arthur O Hall
*Assistant Examiner* — Juan C Barrera
(74) *Attorney, Agent, or Firm* — Rabin & Berdo, P.C.

(57) ABSTRACT

A multifunctional shower head, has a fixed seat, a driving mechanism, a water diversion plate rotatably connected to the fixed seat and a water diversion body. The water diversion body has a plurality of water diversion holes that are used to connect to the outlet functions of the shower head. The water diversion plate has an outlet hole. The driving mechanism drives the water diversion plate to rotate on the water diversion body, so that the outlet hole is alternately connected to part of the water diversion holes to switch the outlet functions of the shower head. A sealing ring is clamped between the water diversion plate and the fixed seat. The sealing ring defines a separating area on the upper surface of the water diversion plate, each water diversion hole has an O-ring, the bottom surface of the water diversion plate is pressed and contacts the O-ring.

11 Claims, 7 Drawing Sheets

MULTIFUNCTIONAL SHOWER HEAD

FIELD OF THE INVENTION

The present invention relates to a shower head, especially to a multifunctional shower head with waterway switch function.

BACKGROUND OF THE INVENTION

Existing shower head with waterway switch function usually comprises a water diversion plate and a driving mechanism to drive the water diversion plate to rotate so as to implement the switch. According to different switch motion, the driving mechanism can be a button switch driving mechanism, a cover plate rotation switch driving mechanism or a swinging switch driving mechanism. Whatever driving mechanism it is, it has to overcome a bigger water pressure when the water diversion plate rotates, thus making it hard to operate. Especially for a button switch driving mechanism, it needs big pressing force, the sealing piece easily moves when the water diversion plate rotates, thus decreasing the sealing performance of the shower head and affecting the sealing effect of the shower head.

SUMMARY OF THE INVENTION

The present invention is provided with a multifunctional shower head which is easy to switch the functions, it overcomes the disadvantages of the existing known technology. The technical proposal of the present invention to solve the technical problems is that:

A multifunctional shower head, comprising a fixed seat, a driving mechanism, a water diversion plate rotatably connected to the fixed seat and a water diversion body disposed below the water diversion plate, the water diversion body is disposed with a plurality of water diversion holes that are used to connected to the outlet functions of the shower head, the water diversion plate is disposed with an outlet hole, the driving mechanism drives the water diversion plate to rotate with respect to the water diversion body, so that the outlet hole is alternately connected to part of the water diversion holes so as to switch the outlet functions of the shower head, wherein a sealing ring is clapped between the water diversion plate and the fixed seat, the sealing ring defines a separating area on the upper surface of the water diversion plate, each water diversion hole is disposed with an O-ring correspondingly, the bottom surface of the water diversion plate is pressed and contacted to the O-ring, therein the O-rings of the water diversion holes disconnected to the outlet holes define a non-water area on the bottom surface of the water diversion plate, the separating area has a similar area with the non-water area.

In another preferred embodiment, it further comprises an elastic piece that presses the water diversion plate to the O-rings tightly, the water diversion plate is further disposed with a passage running through the top and the bottom surface of the water diversion plate.

In another preferred embodiment, it comprises six water diversion holes that are arranged annularly and four outlet holes that are arranged annularly, two adjacent water diversion holes are spaced in 60 degrees, two adjacent outlet holes are spaced in 90 degrees; the driving mechanism is a pressing type one, the driving mechanism drives the water diversion plate to rotate in 30 degrees each time.

In another preferred embodiment, the six water diversion holes are divided into three groups that are respectively connected to three waterways, in these three waterways, the flow volume of one waterway is far less than the other two.

In another preferred embodiment, the fixed seat comprises a main body and a metal mold insert, the metal mold insert is fixedly connected to the bottom surface of the main body, the main body is disposed with an inlet waterway, the inlet waterway is integrally molded into the main body.

In another preferred embodiment, the driving mechanism comprises a button, a swing piece pivoted joint to the fixed seat, a ratchet, a slide piece, a ratchet wheel, a reposition piece used to drive the ratchet to reposition, and a transmission connected to the water diversion plate and the ratchet wheel; pressing the button can make the swing piece push the slide piece to slide, the slide piece drives the ratchet to push the ratchet wheel to rotate.

In another preferred embodiment, the driving mechanism further comprises a stop claw corresponding to the ratchet wheel, the stop claw is connected to the fixed seat.

In another preferred embodiment, the reposition piece is an elastic arm connected to the end portion of the ratchet, the fixed seat is disposed with a stop block corresponding to the reposition piece.

In another preferred embodiment, the reposition piece is a spring disposed to the fixed seat, the ratchet is disposed with a withstanding arm used to press the spring.

In another preferred embodiment, the reposition piece is a spring disposed to the fixed seat, the spring is connected between the slide piece and the fixed seat, the ratchet is locked catch to the slide piece.

Comparing to the existing known technology, the technical proposal of the present invention has advantages as follows:

1. the sealing ring defines a separating area on the top surface of the water diversion plate, the O-ring corresponding to the water diversion hole, which is disconnected to the outlet hole, defines a non-water area on the bottom surface of the water diversion plate, the separating area has a similar area with the non-water area, so that the area on the top surface of the water diversion plate suffers equal pressure to the area on the bottom surface, so that no pressure difference exists on the top and bottom surface of the water diversion plate, the water diversion plate needs light force of rotate, so that it is easy to switch the functions, besides, during waterway switching by the button switch mechanism, in the water flowing state, it needs light force to button switch the waterways, and the switch force of the waterways are identical.

2. the water diversion plate always presses the O-rings during rotating switching, so that the O-rings can't move, the water diversion holes are sealed with stability.

3. The shower head has six water diversion holes that are arranged annularly and four outlet holes that are arranged annularly; so that each time the water diversion plate rotates 30 degrees, two outlet holes align with the two water diversion holes, the structure is simple and skillful.

4. In these three waterways, the flow volume of one waterway is far less than that of the other two, so when switched to the waterway, the user can put the shower gel or shampoo to the body, after that, the user can just press the button again to switch it to the shower state, it doesn't need to close the water and adjust the water temperature again all over the process, so that it is water-saving and convenient.

5. The fixed seat comprises a main body and a metal mold insert, the metal mold insert is connected to the bottom surface of the main body, the metal mold insert has strong crush resistance that it can efficiently avoid deformation of the fixed seat due to water pressure. Besides, when switched to the smallest flow volume, the fixed seat suffers the maximum water pressure, but as the inlet waterway is integrally molded into one side of the main body, the fixed seat can suffer largest water pressure but avoiding leakage.

6. The reposition piece is applied with a spring structure that it can lengthen the service life of the button.

BRIEF DESCRIPTION OF THE DRAWINGS

The present invention will be further described with the drawings and the embodiments.

DETAILED DESCRIPTION OF THE EMBODIMENTS

Figure 1:
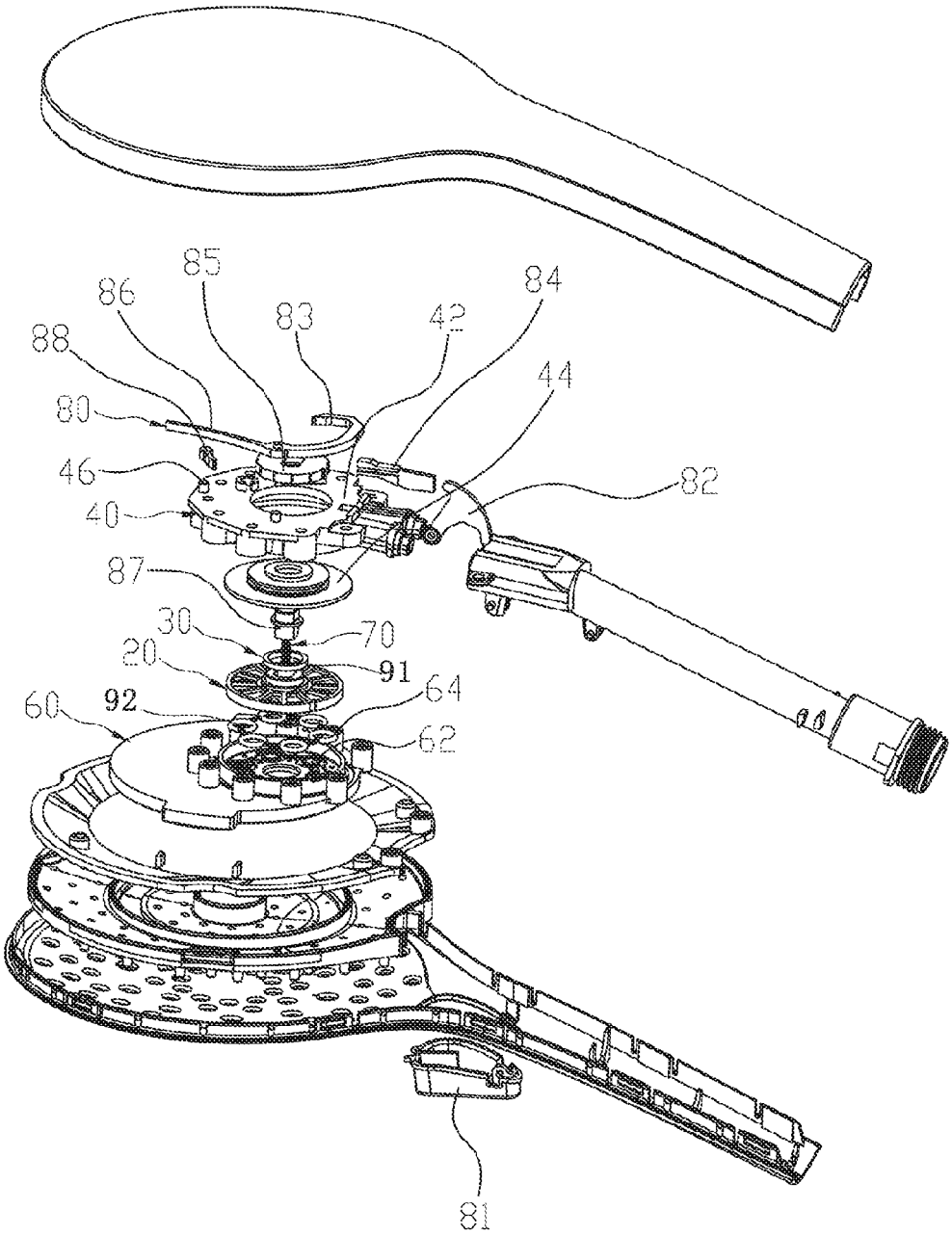
FIG. 1 illustrates an exploded and schematic diagram of a multifunctional shower head of the present invention.

Referring to FIG. 1, a multifunctional shower head of the present invention, which is easy to switch the functions. The shower head comprises a water diversion plate 20, a fixed seat 40 disposed above the water diversion plate 20, a water diversion body 60 below the water diversion plate 20 and a driving mechanism 80 used to drive the water diversion plate 20 to rotate.

Figure 4:
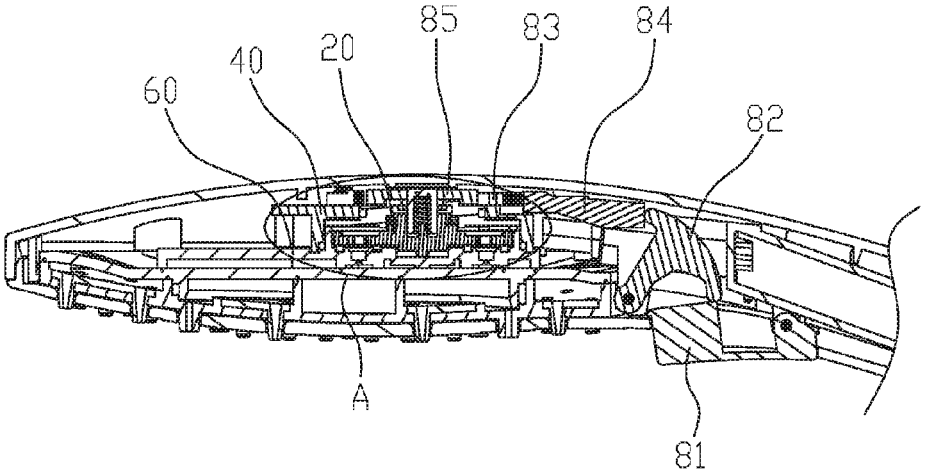
FIG. 4 illustrates a partial sectional diagram of the shower head of FIG. 1.
Figure 5:
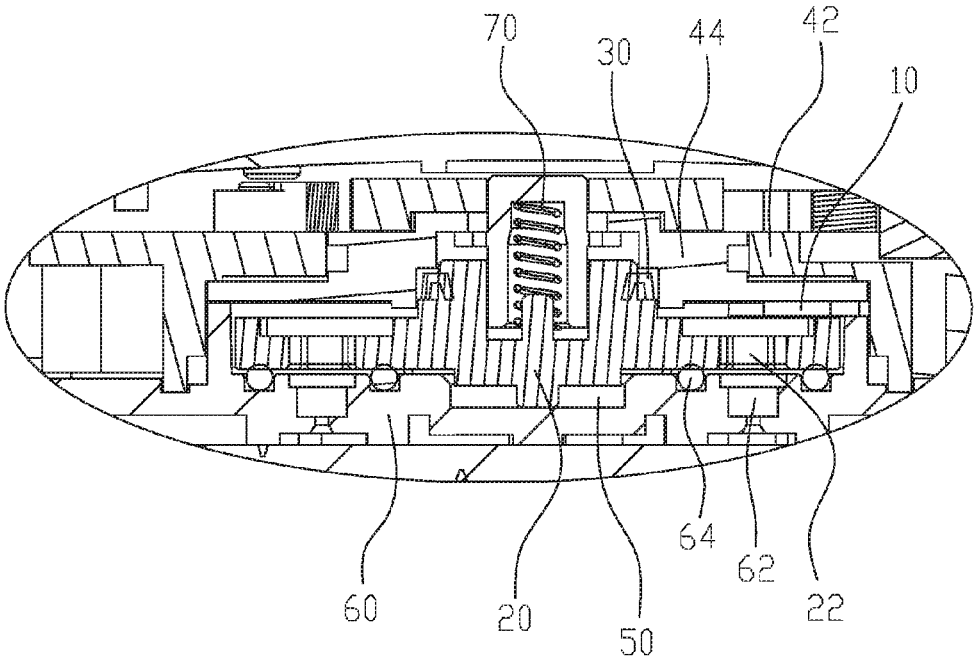
FIG. 5 illustrates an enlargement diagram of A of FIG. 4.

The fixed seat 40 comprises a main body 42 and a metal mold insert 44, the metal mold insert 44 is connected to the bottom surface of the main body 42. As figured in FIG. 4 and FIG. 5, a water chamber 10 is defined between the water diversion plate 20 and the fixed seat 40. The main body 42 is disposed with an inlet waterway, the inlet waterway is integrally molded into the main body 42, the inlet waterway is connected to the water chamber 10. The central portion of the water diversion plate 20 is disposed with a sealing ring 30, the sealing ring is clamped between the water diversion plate 20 and the fixed seat 40. The sealing ring 30 defines a separating area on the top surface of the water diversion plate 20, that is to say, when water enters the water chamber 10, with the sealing ring 30, water can not enter the area of the water diversion plate 20 the sealing ring 30 surrounds, so that no water pressure exists in this area.

Figure 2:
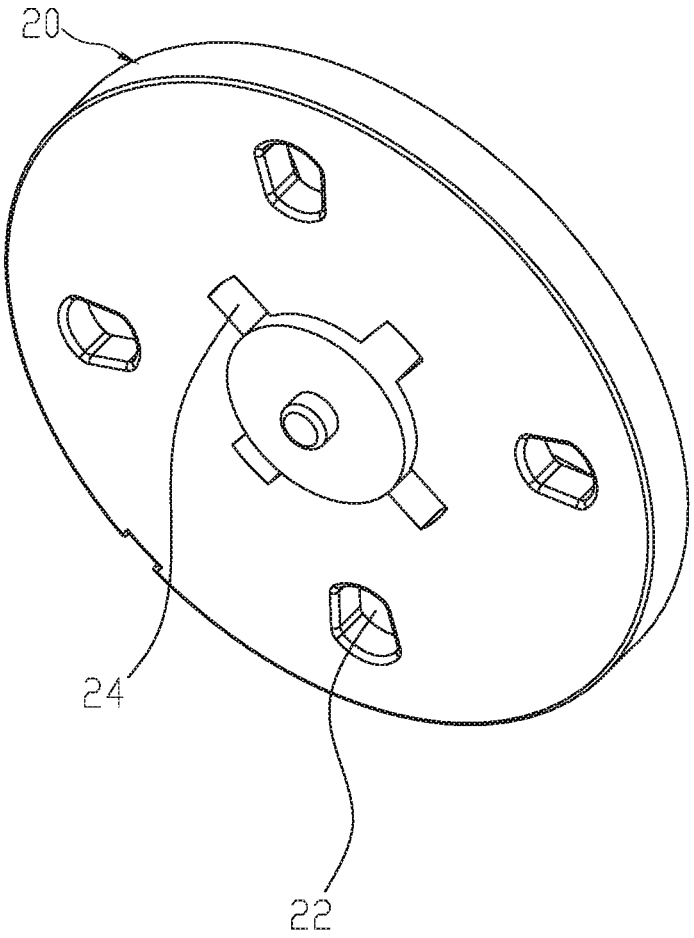
FIG. 2 illustrates a schematic diagram of a water diversion plate of the shower head of FIG. 1.
Figure 3:
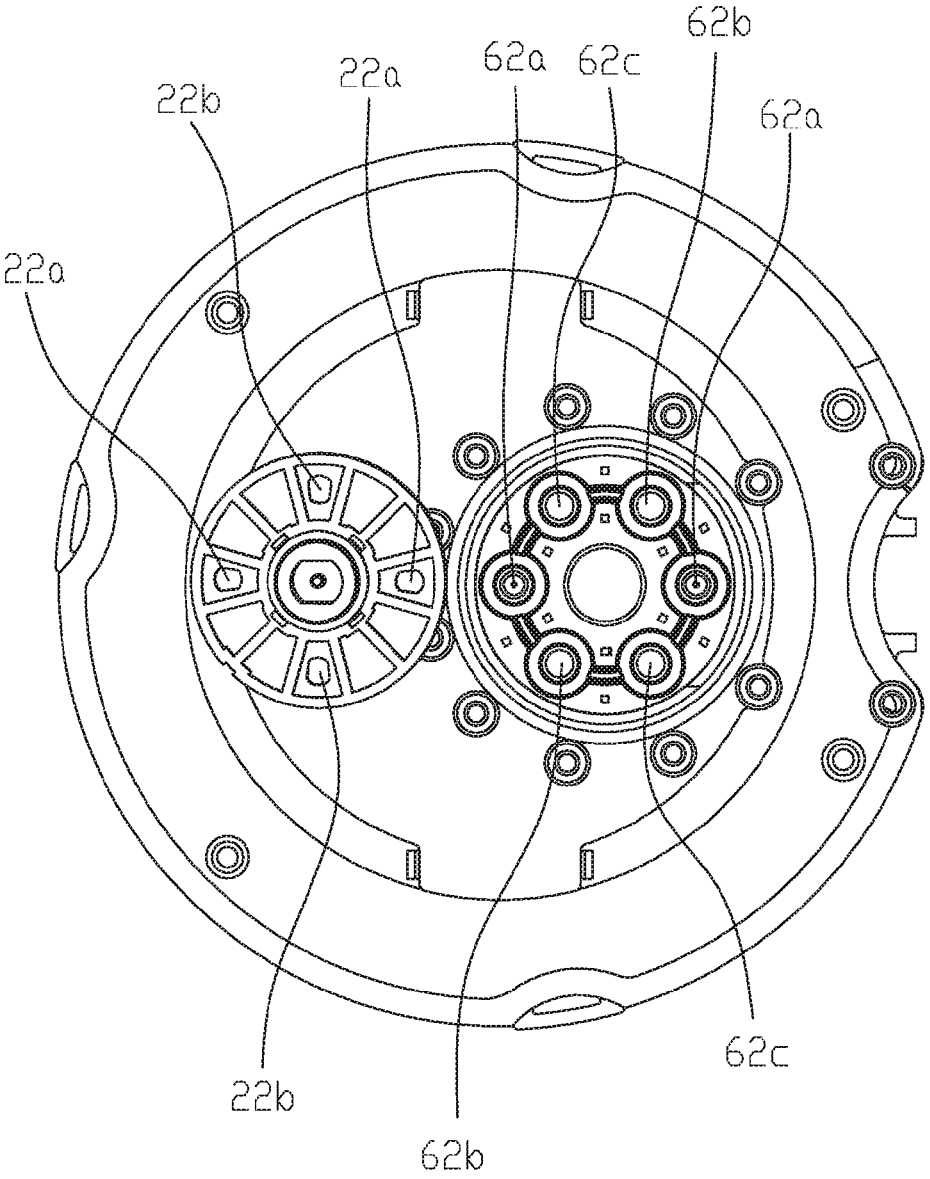
FIG. 3 illustrates a schematic diagram of the water diversion plate and a water diversion body of the shower head of FIG. 1.

Referring to FIG. 1, FIG. 2, FIG. 3, the water diversion plate 20 is disposed with four outlet holes 22 that are arranged annularly, two adjacent outlet holes 22 are spaced in 90 degrees. Therefore, the water pressure area S1 of the top surface of the water diversion plate 20 suffering from the water chamber 10 is: the area of the top surface of the water diversion plate minuses the area the sealing ring 30 surrounds (the area of the separating area) and then minuses the total area of the four outlet holes 22.

The water diversion body 60 is disposed with six water diversion holes 62 that are arranged annularly, two adjacent water diversion holes are spaced 60 degrees. Each water diversion hole 62 has an O-ring 64, six O-rings 64 are connected together. As figured in FIG. 4 and FIG. 5, the water diversion plate 20 and the water diversion body 60 define a decompression cavity 50. An elastic piece 70 presses the water diversion plate 20 onto the O-rings 64. In the working condition, two water diversion holes 62 are connected to the two outlet holes 22, therein, the O-rings corresponding to the four water diversion holes 62, which is disconnected to the outlet holes 22, define a non-water area on the bottom surface of the water diversion plate 20. Therefore, the water pressure area S2 of the bottom surface of the water diversion plate 20 suffering from the decompression cavity 50 is: the area of the bottom surface of the water diversion plate 20 minuses the area of the O-rings 64 corresponding to the four water diversion holes 62, which is disconnected to the outlet holes 22, that is to say, the non-water area, and minuses the area of the four outlet holes. The water diversion plate 20 is further disposed with four passages 24 running through the top and bottom surface of the water diversion plate.

As the top surface and the bottom surface of the water diversion plate have equal area, the separating area and the non-water area have similar area, that is to say, S1≈S2, the water pressures to the top surface and the bottom surface of the water diversion plate are counteracting to each other, so that the water diversion plate 20 rotates with ease.

To describe the waterway switch principle conveniently, four outlet holes 22 are divided into two first outlet holes 22*a* and two second outlet holes 22*b*, six water diversion hoes 62 are divided into two first water diversion holes 62*a*, two second water diversion holes 62*b* and two third water diversion holes 62*c*. Two first water diversion holes 62*a*, two second water diversion holes 62*b*, two third water diversion holes 62*c* are respectively connected to three waterways.

When two first outlet holes 22*a* are aligned to the two first water diversion holes 62*a*, water flows to the first waterway through the first water diversion holes 62*a*, at this time, the shower head outflows a little volume, the shower head is in water-stop condition; when the water diversion plate 20 rotates 30 degrees, two second outlet holes 22*b* are aligned to the two second water diversion holes 62*b*, water flows to the second waterway through the second water diversion holes 62*b*, at this time, the shower head outflows maximum volume, having a first spray pattern; the water diversion plate 20 continues to rotate 30 degrees, two first outlet holes 22*a* are aligned to the two third water diversion holes 62*c*, water flows to the third waterway through the third water diversion holes 62*c*, at this time, the shower head outflows maximum volume, having a second spray pattern; and followed by recycling.

Figure 6:
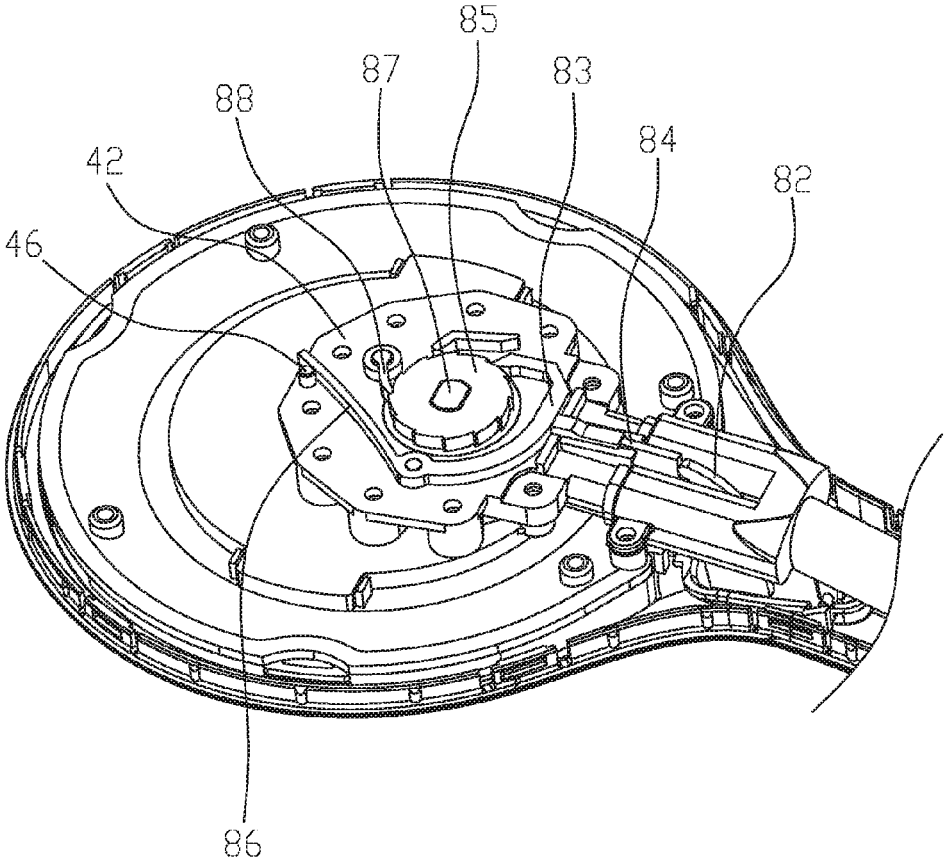
FIG. 6 illustrates a schematic diagram of a driving mechanism of the shower head of FIG. 1.

Referring to FIG. 1 and FIG. 6, how the driving mechanism 80 drives the water diversion plate 20 to rotate will be described hereafter:

The driving mechanism 80 comprises a button 81, a swing element 82 and a ratchet 83 pivoted joint to the fixed seat 40, a slide element 84 connected to the fixed seat 40, a ratchet wheel 85, a reposition element 86 to drive the ratchet 83 to reposition, a transmission 87 connected to the water diversion plate 20 and the ratchet wheel 85, and a stop claw 88 to avoid the ratchet wheel 85 rotating reversely. The reposition element 86 is an elastic arm connected to the end portion of the ratchet 83, the connecting position of the reposition element 86 and the ratchet 83 is pivoted joint to the fixed seat 40, the fixed seat 40 is disposed with a stop block 46 corresponding to the reposition element 86. The strop claw 88 is connected to the fixed seat 40.

Pressing the button 81 can drive the swing element 82 to swing, and the swing element 82 then pushes the slide element 84 to slide, the slide element 84 drives the ratchet 83 to push the ratchet wheel 85 to rotate 30 degrees, with the transmission 87, the water diversion plate 20 rotates 30 degrees synchronously with the ratchet wheel 85, at the same time the reposition element 86 stores energy and drives the ratchet 83 to reposition.

Figure 7:
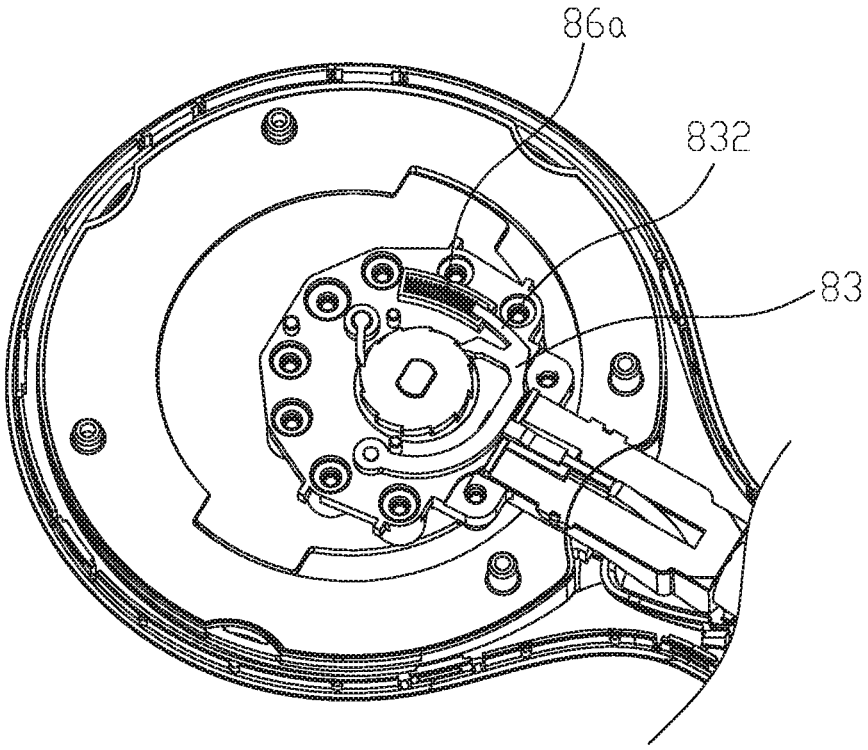
FIG. 7 illustrates a schematic diagram of a second kind of the driving mechanism of the shower head of FIG. 1.

Referring to FIG. 7, the reposition element is a spring 86*a* disposed to the fixed seat 40, the ratchet 83 is disposed with a withstanding arm 832 used to push the spring 86*a*, so that the spring 86*a* can push the withstanding arm 832 to make the ratchet 83 reposition.

Figure 8:
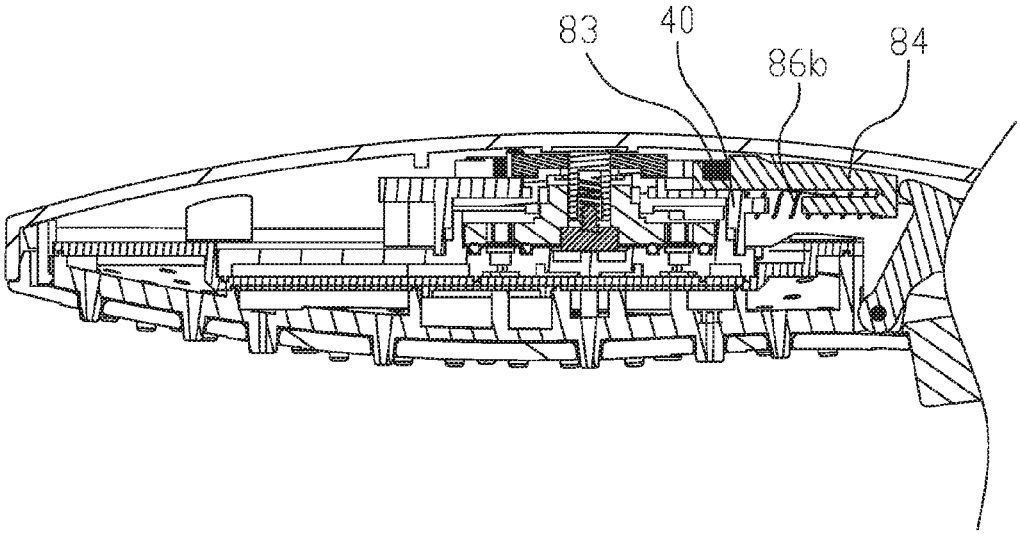
FIG. 8 illustrates a schematic diagram of a third kind of the driving mechanism of the shower head of FIG. 1.

Referring to FIG. 8, in another case, the reposition element is a spring 86*b* disposed in the fixed seat, the spring 86*b* is connected between the slide element 84 and the fixed seat 40, the ratchet 83 is locked to the slide element 84, so that the spring 86*b* can push the slide element 84 to make the ratchet 83 reposition.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A multifunctional shower head having a plurality of shower outlets, comprising:

a fixed seat;

a water diversion plate rotatably connected to the fixed seat, having top and bottom surfaces through which a passage is defined, and having defined therein at least one outlet hole;

a sealing ring that is clamped between the water diversion plate and the fixed seat, and that defines a separating area on the top surface of the water diversion plate;

a driving mechanism;

a water diversion body disposed below the water diversion plate, and having a plurality of water diversion holes defined therein that selectively connect to respective ones of the shower outlets of the multifunctional shower head;

a plurality of O-rings positioned on respective ones of the plurality of water diversion holes and pressed to the bottom surface of the water diversion plate; and an elastic piece that tightly presses the water diversion plate to the O-rings, wherein the driving mechanism drives the water diversion plate to rotate with respect to the water diversion body so that one outlet hole of the at least one outlet hole of the water diversion plate is alternately connected to at least one of the water diversion holes so as to switch the shower outlets of the multifunctional shower head from one to another, wherein the O-rings positioned on respective ones of the plurality of water diversion holes that are selectively disconnected from the at least one outlet hole define a non-water area on the bottom surface of the water diversion plate, wherein the plurality of water diversion holes includes at least two water diversion holes that are arranged annularly so that two adjacent water diversion holes have a distance there between of 60 degrees, wherein the at least one outlet hole includes at least two outlet holes that are arranged annularly so that two adjacent outlet holes have a distance there between of 90 degrees, and wherein the driving mechanism is a pressing type driving mechanism that drives the water diversion plate to rotate with respect to the water diversion body by 30 degrees each time engaged.

2. The multifunctional shower head according to claim 1, wherein the at least two water diversion holes are divided into three groups that are respectively connected to three waterways, one waterway of the three waterways having a flow volume that is less than that of the other waterways.

3. The multifunctional shower head according to claim 2, wherein the fixed seat comprises:

a main body having an inlet waterway integrally molded therein and having a bottom surface; and a metal mold insert fixedly connected to the bottom surface of the main body.

4. The multifunctional shower head according to claim 1, wherein the fixed seat comprises:

a main body having an inlet waterway integrally molded therein and having a bottom surface; and a metal mold insert fixedly connected to the bottom surface of the main body.

5. The multifunctional shower head according to claim 1, wherein the driving mechanism comprises:

a button;

a swing piece pivotally joined to the fixed seat and connected to the button;

a slide piece joined to the swing piece;

a ratchet;

a ratchet wheel connected to the ratchet;

a reposition piece used to drive the ratchet to reposition the ratchet; and a transmission connected to the water diversion plate and the ratchet wheel, and wherein pressing the button causes the swing piece to push the slide piece to slide, and the slide piece drives the ratchet to push the ratchet wheel to rotate.

6. The multifunctional shower head according to claim 5, wherein the driving mechanism further comprises a stop claw that is connected to the fixed seat and that corresponds to the ratchet wheel.

7. The multifunctional shower head according to claim 5, wherein the ratchet has an end portion, wherein the reposition piece is an elastic arm that is connected to the end portion of the ratchet, and wherein the fixed seat is disposed with a stop block corresponding to the reposition piece.

8. The multifunctional shower head according to claim 5, wherein the reposition piece is a spring that engages the fixed seat, and wherein the ratchet is disposed with a withstanding arm that pressingly engages the spring.

9. The multifunctional shower head according to claim 5, wherein the reposition piece is a spring that engages the fixed seat and is connected between the slide piece and the fixed seat, and wherein the ratchet is locked catch to the slide piece.

10. The multifunctional shower head according to claim 1, wherein the fixed seat comprises:

a main body having an inlet waterway integrally molded therein and having a bottom surface; and a metal mold insert fixedly connected to the bottom surface of the main body.

11. The multifunctional shower head according to claim 1, wherein the fixed seat comprises; a main body having an inlet waterway integrally molded therein and having a bottom surface; and a metal mold insert fixedly connected to the bottom surface of the main body.

* * * * *